US007658702B1

(12) United States Patent
Harms

(10) Patent No.: US 7,658,702 B1
(45) Date of Patent: Feb. 9, 2010

(54) PUSH-UP BENCH

(76) Inventor: David E. Harms, 15242 110th St., Alden, IA (US) 50006

( * ) Notice: Subject to any disclaimer, the term of this patent is extended or adjusted under 35 U.S.C. 154(b) by 0 days.

(21) Appl. No.: 12/410,568

(22) Filed: Mar. 25, 2009

(51) Int. Cl.
*A63B 26/00* (2006.01)

(52) U.S. Cl. ..... 482/141

(58) Field of Classification Search ..... 482/62, 482/141, 142, 148, 91, 907, 908
See application file for complete search history.

(56) References Cited

U.S. PATENT DOCUMENTS 5,181,897 A 1/1993 Agan
5,226,868 A 7/1993 Montgomery
5,697,875 A 12/1997 Stan
5,928,119 A 7/1999 Dinkel
7,060,014 B2 6/2006 Bergman et al.
2008/0045390 A1 2/2008 Harms

*Primary Examiner*—Lori Baker
(74) *Attorney, Agent, or Firm*—James Ray & Assoc.

(57) ABSTRACT

An adjustable exercise device for performing push-ups is provided. The push-up bench is designed to accommodate exercisers of varying heights, sizes and fitness levels. The exercise device comprises a base assembly, an inclined exercise platform assembly flexibly attached to the base along one end, and a connecting leg assembly which is connected to both the base and the inclined platform. Adjustment of the leg assembly with respect to the base adjusts the inclined platform from a fully horizontal position to multiple degrees of inclination, providing multiple degrees of exercise difficulty. The inclined platform may also include foot pads and hand grips to properly position the exerciser. The inclined platform is adjustable lengthwise to permit the distance between hand grips and foot pads to be adjusted, to accommodate users of varying heights.

10 Claims, 3 Drawing Sheets

PUSH-UP BENCH

FIELD OF THE INVENTION

The present invention relates, in general, to exercise equipment and, more particularly, this invention relates to an adjustable push-up bench.

BACKGROUND OF THE INVENTION

Many exercising adults and children performing push-ups experience difficulty, often because a lack of upper body strength may not allow for effective performance in the standard position. There is a need in the art for a simple and effective device to provide users of any ability the encouragement and support to begin and continue a routine of push-ups designed to build muscle strength, endurance and definition.

Prior to the conception and development of the present invention, as is generally well known in the prior art, several examples of push-up devices have been disclosed. Several examples disclose devices in which the exercise is completed at a non-adjustable fixed angle. One such example is provided in U.S. Pat. No. 5,226,868 to Montgomery, which discloses an exercise device comprising a push-up board that includes two push-up handles. The handles can be mounted at various positions on the board, providing the user multiple exercise routines.

Other examples disclose push-up devices that allow a user to perform inclined push-ups, but only at a fixed angle. U.S. Pat. No. 5,928,119 to Dinkel discloses an inclined push-up device for allowing persons with knee or back problems to exercise more safely. A static platform is utilized to allow a user to complete push-ups from an inclined but fixed angle. U.S. Pat. No. 5,181,897 to Agan discloses an inclined push-up exercise apparatus in which the device is positioned against the edge of a wall, desk or the like, creating the opportunity to complete inclined push-ups at a fixed angle. The angle of inclination is dependent on the surface chosen to position the device.

Other push-up devices provide a user the opportunity to complete push-ups from a variety of angles. U.S. Pat. No. 5,697,875 to Stan discloses a collapsible high-low push-up exerciser, in which a user positions a push-up bar at selected heights. The invention of Stan provides no support for the body of an exerciser, increasing stress upon the back and legs.

U.S. Pat. No. 7,060,014 to Bergman et al. discloses a device and method for performing push-ups. The Bergman device includes a body support platform upon which the user is restrained in a prone position by a combination of straps which may be tightened around the user's back and legs, causing possible discomfort. The body support platform is maintained at an angle with respect to a support base, and the angle may be adjusted by the user. The support base includes handles which may be ergonomically positioned to accommodate the physical requirements of users. The handles as disclosed by Bergman are attached to the support base rather than the body support platform. A bias mechanism such as a series of elastomeric bands provides either assisting or resisting force, to be selected by the user.

The present invention, as described and claimed below, has been designed to combine many desirable features disclosed in the prior art, and to improve upon them. The device of the present invention is designed to easily adjust to accommodate a wide variety of exercisers of various shapes, sizes and fitness levels with minimum discomfort.

SUMMARY OF THE INVENTION

The present invention provides an adjustable push-up bench designed for users of various sizes and strength levels. In one embodiment the present invention is an adjustable exercise device for performing push-ups comprising: a generally rectangular base, said base including an end rail, a foot rail positioned opposite said end rail, two side rails positioned opposite one another and connected to said end rail and said foot rail to form a generally rectangular perimeter; a generally rectangular inclined frame hingedly attached to said end rail of said rectangular base, said inclined frame including two side rails positioned opposite of each other, said two side rails connecting said end rail to a hand rail, thereby forming a generally rectangular perimeter, said two side rails each comprising a telescopic adjustment rail and a first inclined foot rail hingedly connected to said hand rail and to said foot rail, a second inclined foot rail hingedly connected to said hand rail and to said foot rail, wherein said generally rectangular base is flexibly attached to said first inclined foot rail and second inclined foot rail, said two side rails of said generally rectangular base each comprise a telescopic adjustment rail such that said first inclined foot rail can move through a range of angles of inclination with respect to said generally rectangular base. In another embodiment the present invention further includes at least one foot pad attached to said foot rail of said generally rectangular base. In another embodiment the present invention said hand rail further comprises a cushioned hand grip. In another embodiment of the present invention the exercise device is constructed substantially of at least one type of plastic. In another embodiment the present invention the exercise device is constructed substantially of at least one type of polyvinyl chloride. In another embodiment the present invention further comprises an adjustable handle bar which connects said inclined foot rails to each other and is movable along said inclined foot rails to accommodate exercisers of varying heights. In another embodiment of the present invention said handle bar further comprises a cushioned hand grip. In another embodiment of the present invention said telescopic adjustment rails of said side rails include a plurality of apertures spaced along and extending through said telescopic adjustment rails, said apertures engagable with at least one aperture on said side rails.

In still another embodiment the invention is an adjustable exercise device for performing push-ups comprising: a generally rectangular base, said base including an end rail, a foot rail positioned opposite said end rail, two side rails positioned opposite one another and connected to said end rail and said foot rail to form a generally rectangular perimeter; a generally rectangular inclined frame flexibly attached to said end rail of said rectangular base, said inclined frame including two side rails positioned opposite of each other, said two side rails connecting said end rail to a hand rail, thereby forming a generally rectangular perimeter, said two side rails each comprising a telescopic adjustment rail and a first inclined foot rail flexibly connected to said hand rail and to said foot rail, a second inclined foot rail flexibly connected to said hand rail and to said foot rail, at least one foot pad attached to said foot rail of said generally rectangular base, an adjustable handle bar which connects said inclined foot rails to each other and is movable along said inclined foot rails to accommodate exercisers of varying heights, wherein said generally rectangular base is flexibly attached to said first inclined foot rail and second inclined foot rail, said two side rails of said generally rectangular base each comprise a telescopic adjustment rail such that said first inclined foot rail can move through a range of angles of inclination with respect to said generally rectangular base to accommodate exercisers of varying fitness levels. In another embodiment of the present invention the exercise device is constructed substantially of at least one type of plastic. In another embodiment of the present invention the exercise device is constructed substantially of at least one type of polyvinyl chloride. In another embodiment of the present invention said handle bar further comprises a cushioned hand grip. In another embodiment of the present invention said hand rail further comprises a cushioned hand grip. In another embodiment of the present invention said telescopic adjustment rails of said side rails include a plurality of apertures spaced along and extending through said telescopic adjustment rails, said apertures engagable with at least one aperture on said side rails.

The device comprises three basic assemblies: a generally rectangular base member, designed to rest on a floor or other similar level surface; a generally rectangular inclined member, which is flexibly attached to the base member and which provides the platform upon which the user performs push-up exercises; and a connecting leg member, which is attached to both the base member and the inclined member. Adjustment of the connecting leg member between a substantially horizontal position with respect to the base member and a substantially vertical position, with multiple gradations in between, in turn adjusts the inclined member into multiple angles of inclination. The possible components of each assembly and their interrelationships will be detailed below.

The generally rectangular base member may comprise an end rail, an intermediate rail parallel to and positioned opposite the end rail, and two side rails, also positioned parallel to and opposite one another. The end rail and the intermediate rail are attached at each end to each of the two side rails. The intermediate rail is positioned roughly at the midpoint of the length of the side rails. The two side rails, the end rail, and the intermediate rail are assembled to form the generally rectangular perimeter of the base member. An additional end rail, attached to the side rails at the end farthest from the end rail and closing the generally rectangular base, may be added to provide additional structural support to the base. In a preferred embodiment of the invention, the two side rails are longer than the end rail and intermediate rail. The base may also include adjustment rails, which could be attached at one end to the end rail and at its other end to the intermediate rail, at roughly the midpoint in length of the intermediate rail and end rail. Thus the adjustment rail is parallel to the side rails of the base, and spans the length between the intermediate rail and the end rail.

The inclined member likewise is preferably generally rectangular, and comprises an end member, an oppositely positioned end assembly, and two side rails, which are parallel and positioned opposite one another. The end member, end assembly, and two side rails may be assembled to form the generally rectangular perimeter of the inclined member. The end member of the inclined member is flexibly attached to the base member, by at least one hinge or equivalent attachment. Foot pads are also preferably attached to the end member of the inclined member for the comfort of users of the invention. The end assembly of the inclined member may further include a hand grip for the user, or alternatively may serve as an attachment point for an ergonomically acceptable hand grip. The end assembly may a linear rail member, or in another embodiment, be a U-shaped structure, where the free ends of the "U" engage the side rails of the inclined member. The length of the inclined member may be fixed or adjustable. In a preferred embodiment, the inclined member is adjustable in length, so that the distance between the foot pads and the hand grip can be selected by the user.

The connecting leg member could be comprised of one end rail, and two parallel side rails positioned parallel to and opposite one another. The two side rails are each attached to the end rail at one end, forming a U-shaped configuration. An optional cross bar, parallel to the end rail and attached to each side rail at roughly the midpoint of the length of the side rails, may be added for support purposes. The free ends of the side rails of the U-shaped configuration are preferably hingedly attached to the side rails of the inclined member, so that the inclined member and connecting leg member move with respect to one another during adjustment of the device. The end rail of the connecting leg is preferably connected to the adjustment bar of the base member. Thus the connecting leg connects the base member and the inclined member such that the connecting leg props the inclined member in an inclined position with respect to the base. The connecting leg is preferably flexibly attached to a fixed point along the length of the respective side rails of the inclined member. The end rail of the connecting leg maybe adjustably attached to the base at the adjustment rail;

the connecting leg can be released and moved to multiple positions along the adjustment rail. The verticality of the connecting leg, and in turn, the inclination of the inclined member the connecting leg supports, is adjusted by this mechanism. There are many potential embodiments of the invention one preferred embodiment will be detailed in the detailed description.

OBJECTS OF THE INVENTION

It is, therefore, one of the primary objects of the present invention to provide a device designed to facilitate the proper performance of push-ups.

Another object of the present invention is to provide an exercise device which reduces the strain on the back, knees and legs of the user often associated with performing push-ups.

Still another object of the present invention is to provide a device which can be easily adjusted to accommodate the strength level of multiple users, simply by adjusting the angle at which an exercise platform is inclined.

Yet another object of the present invention is to provide a device which can be easily adjusted to accommodate users of varying heights, by adjusting the relative position of the hand grips and foot pads on the inclined exercise platform.

Yet still another object of the present invention is to provide a device which is lightweight and stable.

A final object of the present invention is to provide a collapsible push-up bench that folds into a flat configuration for convenient shipping and storage.

In addition to the various objects and advantages of the present invention described with some degree of specificity above it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
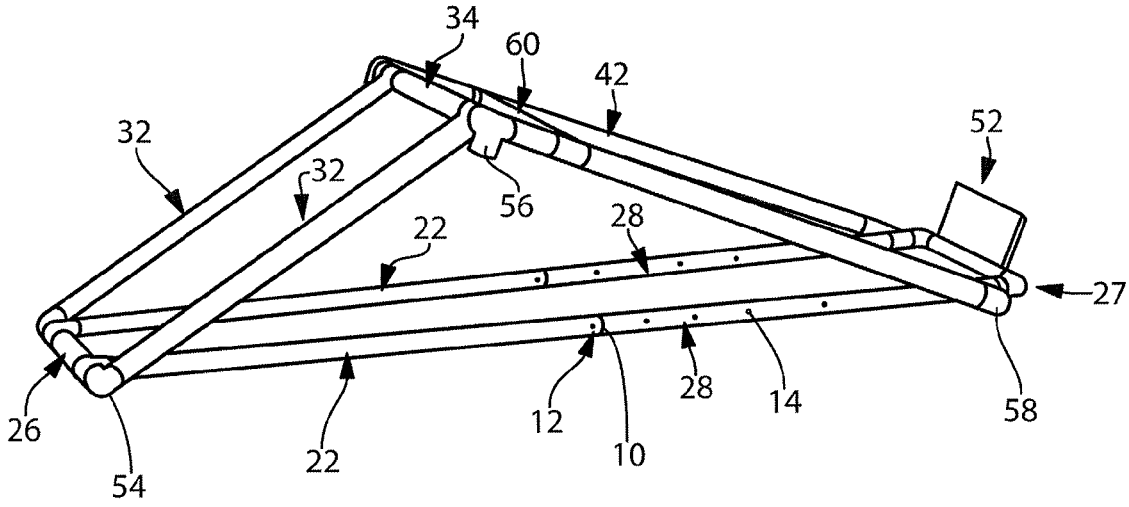
FIG. 1 is a perspective view of the invention, illustrating an intermediate position of inclination.

BRIEF DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Reference is now made, more particularly, to FIG. 1, which is a perspective view of one embodiment of the present invention. The generally rectangular base 20 is comprised of an end rail 26, a foot rail 27 and two side rails 22 which form a generally rectangular perimeter. Side rails 22 include telescopic adjustment rails 28, which slide into the interior of side rails 22, and are secured into place by pins 10. Pins 10 are placed in set holes 12 in side rails 22, and through one of a plurality of adjustment holes 14 in adjustment rails 28 to secure the bench in a selected position. It is envisioned that other fastening means could be used instead of pins 10, including screws, bolts, clips and their equivalents in the art.

Hand rail 34 is flexibly attached to inclined side rails 32 and inclined foot rails 42 by attachment means 56. Inclined side rails 32 are flexibly attached to the end rail 26 by attachment means 54. Foot rail 27 is flexibly attached to inclined foot rails 42 by attachment means 58. In a preferred embodiment, suitable attachment means 54, 56 and 58 would each include at least one hinge.

In several embodiments of the present invention inclined foot rails 42 include an adjustable handle bar 60 which connects foot rails 42 to each other and provides an alternative location for placing a users hands during use. Adjustable handle bar 60 can be positioned at any point along foot rails 42 to allow users of varying heights to comfortably and properly use the bench. The adjustment means could be tube clamps, set screw, set screw with slip tees, or the like.

Foot pads 52 are attached to foot rail 27 to provide the user a comfortable posture while performing push-ups at an inclined level, minimizing strain on the user's back, knees and legs.

Figure 2:
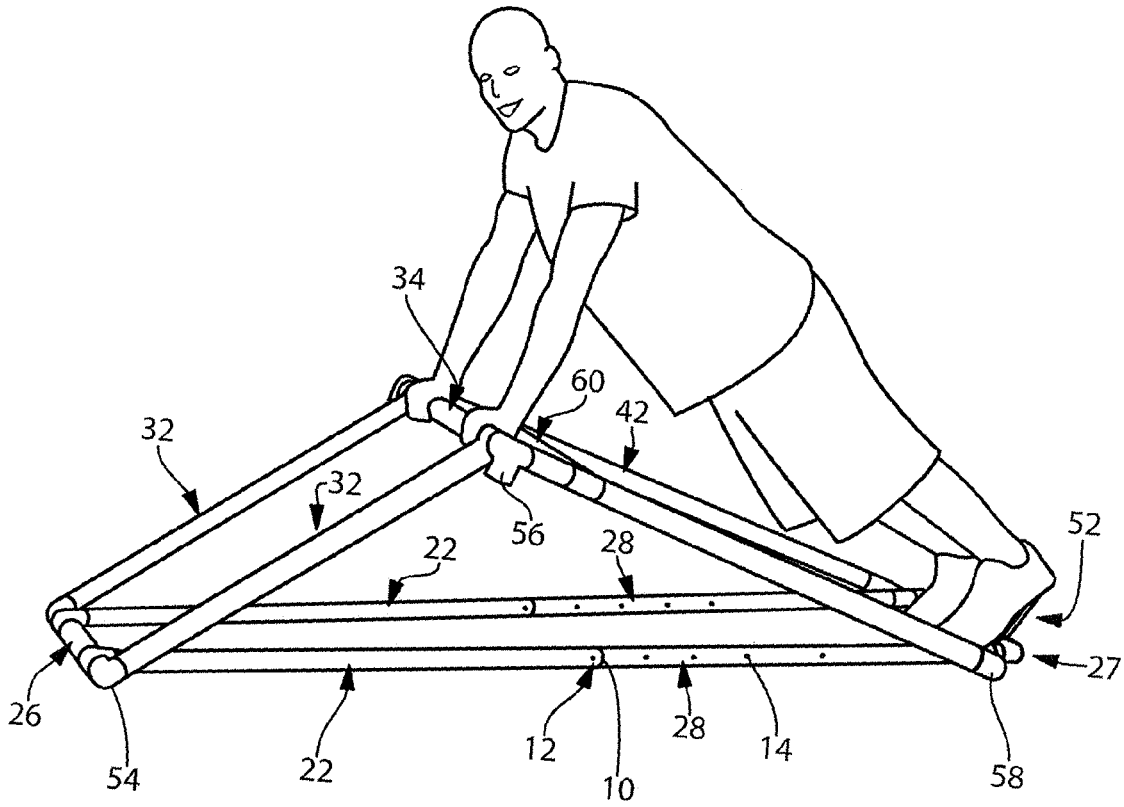
FIG. 2 is a perspective view of the invention, illustrating an intermediate position of inclination while in use by a user.

Reference is now made to FIG. 2, a perspective view of a preferred embodiment of the present invention, illustrating an intermediate position of inclination while in use by a user. The generally rectangular base 20 is comprised of an end rail 26, a foot rail 27 and two side rails 22 which form a generally rectangular perimeter. Side rails 22 include telescopic adjustment rails 28, that slide into the interior of side rails 22, and are secured into place by pins 10. Pins 10 are placed in set holes 12 in side rails 22, and through one of a plurality of adjustment holes 14 in adjustment rails 28 to secure the bench in a selected position. It is envisioned that other fastening means could be used instead of pins 10, including screws, bolts, clips and their equivalents in the art.

Hand rail 34 is flexibly attached to inclined side rails 32 and inclined foot rails 42 by attachment means 56. Inclined side rails 32 are flexibly attached to the end rail 26 by attachment means 54. Foot rail 27 is flexibly attached to inclined foot rails 42 by attachment means 58. In a preferred embodiment, suitable attachment means 54, 56 and 58 would each include at least one hinge.

In several embodiments of the present invention inclined foot rails 42 include an adjustable handle bar 60 which connects foot rails 42 to each other and provides an alternative location for placing a users hands during use. Adjustable handle bar 60 can be positioned at any point along foot rails 42 to allow users of varying heights to comfortably and properly use the bench. The adjustment means could be tube clamps, set screw, set screw with slip tees, or the like.

Foot pads 52 are attached to foot rail 27 to provide the user a comfortable posture while performing push-ups at an inclined level, minimizing strain on the user's back, knees and legs.

Figure 3:
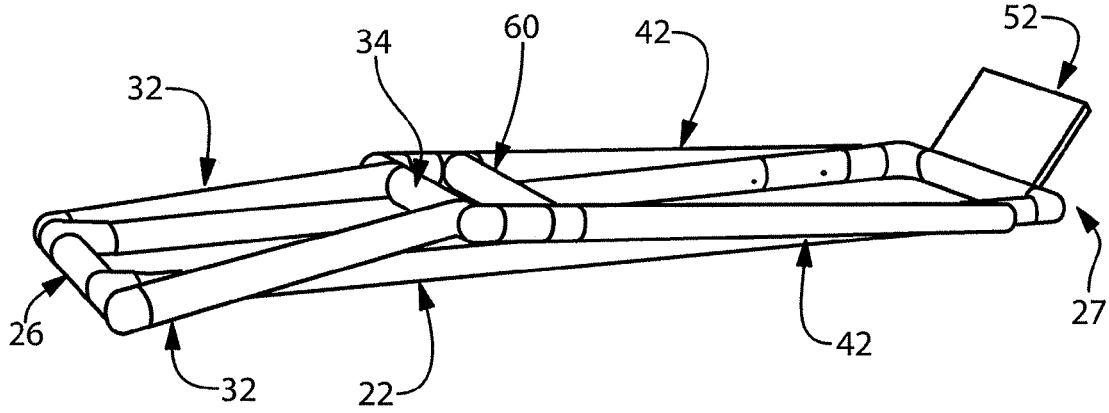
FIG. 3 is a perspective view illustrating the inclined platform in fully horizontal position.

Reference is now made, more particularly, to FIG. 3, a perspective view illustrating the inclined apparatus in a fully horizontal position. This would also represent the preferred configuration for shipping or storage purposes. In this position the bench takes up the least volume and could be easily shipped. Also, the bench could be stored in narrow spaces such as under a bed, or similar areas.

The materials utilized to construct the device described above are well-known to one skilled in the art. The basic structural frame of the push-up bench is preferably impact-resistant hard plastics durable, but corrosion-resistant metal or lightweight ceramic or composite materials would also be appropriate. The hand grips or portions of the hand rails are preferably coated with a cushioning foam material, selected to be resistant to moisture and perspiration. The unit itself measures approximately 72 inches long and 24 inches wide in its flattened position. The unit could be adapted to larger or smaller configurations.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

What is claimed:

1. An adjustable exercise device for performing push-ups comprising:

a. a generally rectangular base, said base including an end rail, a foot rail positioned opposite said end rail, two side rails positioned opposite one another and connected to said end rail and said foot rail to form a generally rectangular perimeter;

b. a generally rectangular inclined frame hingedly attached to said end rail of said rectangular base, said inclined frame including two side rails positioned opposite of each other, said two side rails connecting said end rail to a hand rail, thereby forming a generally rectangular perimeter, said two side rails each comprising a telescopic adjustment rail and c. a first inclined foot rail hingedly connected to said hand rail and to said foot rail, a second inclined foot rail hingedly connected to said hand rail and to said foot rail, wherein said generally rectangular base is flexibly attached to said first inclined foot rail and second inclined foot rail, said two side rails of said generally rectangular base each comprise a telescopic adjustment rail such that said first inclined foot rail can move through a range of angles of inclination with respect to said generally rectangular base.

2. An adjustable exercise device as in claim 1, further including at least one foot pad attached to said foot rail of said generally rectangular base.

3. An adjustable exercise device as in claim 2, wherein said hand rail further comprises a cushioned hand grip.

4. An adjustable exercise device as in claim 1, further comprising an adjustable handle bar which connects said inclined foot rails to each other and is movable along said inclined foot rails to accommodate exercisers of varying heights.

5. An adjustable exercise device as in claim 4, wherein said handle bar further comprises a cushioned hand grip.

6. The adjustable exercise device as recited in claim 1, wherein said telescopic adjustment rails of said side rails include a plurality of apertures spaced along and extending through said telescopic adjustment rails, said apertures engagable with at least one aperture on said side rails.

7. An adjustable exercise device for performing push-ups comprising:

a. a generally rectangular base, said base including an end rail, a foot rail positioned opposite said end rail, two side rails positioned opposite one another and connected to said end rail and said foot rail to form a generally rectangular perimeter;

b. a generally rectangular inclined frame flexibly attached to said end rail of said rectangular base, said inclined frame including two side rails positioned opposite of each other, said two side rails connecting said end rail to a hand rail, thereby forming a generally rectangular perimeter, said two side rails each comprising a telescopic adjustment rail and c. a first inclined foot rail flexibly connected to said hand rail and to said foot rail, a second inclined foot rail flexibly connected to said hand rail and to said foot rail, at least one foot pad attached to said foot rail of said generally rectangular base, an adjustable handle bar which connects said inclined foot rails to each other and is movable along said inclined foot rails to accommodate exercisers of varying heights, wherein said generally rectangular base is flexibly attached to said first inclined foot rail and second inclined foot rail, said two side rails of said generally rectangular base each comprise a telescopic adjustment rail such that said first inclined foot rail can move through a range of angles of inclination with respect to said generally rectangular base to accommodate exercisers of varying fitness levels.

8. An adjustable exercise device as in claim 7, wherein said handle bar further comprises a cushioned hand grip.

9. An adjustable exercise device as in claim 7, wherein said hand rail further comprises a cushioned hand grip.

10. The adjustable exercise device as recited in claim 7, wherein said telescopic adjustment rails of said side rails include a plurality of apertures spaced along and extending through said telescopic adjustment rails, said apertures engagable with at least one aperture on said side rails.

* * * * *